US006550966B1

(12) United States Patent
Saad et al.

(10) Patent No.: US 6,550,966 B1
(45) **Date of Patent: *Apr. 22, 2003**

(54) FREEZER STORAGE BAG

(75) Inventors: Zain E. M. Saad, Midland, MI (US); Douglas P. Gundlach, Midland, MI (US); Virginia D. Karul, Midland, MI (US); Roger D. Vrooman, Newport News, VA (US); Roger V. McIntosh, Midland, MI (US); Richard Dawkins, Saginaw, MI (US); David A. Smith, Midland, MI (US); Michael A. Babinec, Midland, MI (US); Linda W. Allison, Sanford, MI (US); Claudia J. Gerardo, Austin, TX (US)

(73) Assignee: S.C. Johnson Home Storage, Inc., Racine, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/776,681

(22) PCT Filed: Aug. 28, 1995

(86) PCT No.: PCT/US95/10862

§ 371 (c)(1),
(2), (4) Date: May 12, 1997

(87) PCT Pub. No.: WO96/06733

PCT Pub. Date: Mar. 7, 1996

(51) Int. Cl.[7] ..... B65D 30/08; B65D 30/22; B65D 33/16; B65D 85/00

(52) U.S. Cl. ..... 383/103; 383/100; 383/109; 383/119; 426/127; 426/129; 426/415; 426/418; 428/35.2; 428/35.3; 428/35.7; 428/156; 428/216; 428/220

(58) Field of Search ..... 428/35.2, 35.7, 428/216, 220, 156; 383/100, 103, 109, 119

(56) References Cited

U.S. PATENT DOCUMENTS

| | | | | |
|---|---|---|---|---|
| 2,638,952 | A | 5/1953 | Sanderson | 150/49 |
| 3,008,862 | A | 11/1961 | Haine et al. | 156/244 |
| 3,282,412 | A | 11/1966 | Corella et al. | 206/47 |
| 3,494,457 | A | 2/1970 | Tichenal | 206/46 |

(List continued on next page.)

FOREIGN PATENT DOCUMENTS

| | | |
|---|---|---|
| CH | 359659 | 7/1958 |
| EP | 0 373 506 A1 | 6/1990 |
| EP | 0 373 748 | 6/1990 |
| EP | 0 755 875 A1 | 1/1997 |

(List continued on next page.)

OTHER PUBLICATIONS

Hodges, "Rodale's Complete Book of Home Freezing," pp. 173–175 (1984).

Consumer Reports, "Keeping Food Fresh," pp. 143–147 (Mar. 1994).

(List continued on next page.)

*Primary Examiner*—Sandra M. Nolan

(57) ABSTRACT

A recloseable multibag freezer bag including an inner liner bag and an outer support bag. The inner liner bag is a thermoplastic with a thickness of less than 2 mil and a specified secant modulus, has a mouth through which the interior of the inner liner bag is accessible, and is joined by a mouth seal to the throat of the support bag along the entire length of the mouth of the liner bag substantially enclosing an air space between facing walls of the inner liner bag and outer support bag. The outer support bag is a thermoplastic, and has a mouth and a throat. A recloseable mouth seal is affixed to its mouth to provide recloseable access to the interior of the liner bag through the outer bag while maintaining the enclosed air space between the inner and outer bags.

37 Claims, 7 Drawing Sheets

U.S. PATENT DOCUMENTS

| | | | | | |
|---|---|---|---|---|---|
| 3,625,348 | A | * | 12/1971 | Titchenal et al. | 206/46 |
| 3,734,394 | A | | 5/1973 | Dooley | 229/55 |
| 3,746,215 | A | | 7/1973 | Ausnit et al. | 222/92 |
| 3,762,628 | A | | 10/1973 | Sargent | 229/56 |
| 3,844,409 | A | | 10/1974 | Bodolay et al. | 206/45.34 |
| 3,929,275 | A | * | 12/1975 | Bolling et al. | 229/55 |
| 3,945,873 | A | | 3/1976 | Osborn | 156/271 |
| 3,977,596 | A | | 8/1976 | Gamble | 229/54 |
| 4,172,152 | A | | 10/1979 | Carlisle | 426/127 |
| 4,186,786 | A | | 2/1980 | Kirkpatrick | 150/3 |
| 4,211,091 | A | | 7/1980 | Campbell | 62/372 |
| 4,211,267 | A | | 7/1980 | Skovgaard | 150/2.1 |
| 4,226,330 | A | | 10/1980 | Butler | 206/620 |
| 4,256,256 | A | | 3/1981 | Meyers | 229/56 |
| 4,323,586 | A | | 4/1982 | Long | 426/412 |
| 4,358,466 | A | | 11/1982 | Stevenson | 426/106 |
| 4,411,919 | A | | 10/1983 | Thompson | 426/412 |
| 4,428,788 | A | | 1/1984 | Kamp | 156/66 |
| 4,481,669 | A | * | 11/1984 | Pezzana et al. | 383/94 |
| 4,540,089 | A | | 9/1985 | Maloney | 206/219 |
| 4,691,368 | A | | 9/1987 | Roessiger | 383/10 |
| 4,735,308 | A | | 4/1988 | Barner | 206/204 |
| 4,741,789 | A | | 5/1988 | Zieke et al. | 156/66 |
| 4,743,123 | A | | 5/1988 | Legters et al. | 383/103 |
| 4,758,099 | A | | 7/1988 | Branson | 383/44 |
| 4,797,010 | A | | 1/1989 | Coelbo | 383/109 |
| 4,861,632 | A | | 8/1989 | Caggiano | 428/35.2 |
| 4,890,936 | A | * | 1/1990 | Cooper | 383/109 |
| 4,925,316 | A | | 5/1990 | Van Erden et al. | 383/61 |
| 4,951,666 | A | | 8/1990 | Inman et al. | 128/402 |
| 4,993,844 | A | | 2/1991 | Robinson et al. | 383/38 |
| 5,005,679 | A | | 4/1991 | Hjelle | 190/110 |
| 5,020,922 | A | * | 6/1991 | Schirmer et al. | 383/119 |
| 5,049,223 | A | | 9/1991 | Dais et al. | 156/244 |
| 5,108,814 | A | * | 4/1992 | Harp et al. | 428/156 |
| 5,140,845 | A | * | 8/1992 | Robbins | 73/19.03 |
| 5,176,251 | A | | 1/1993 | Davis et al. | 206/205 |
| 5,256,428 | A | | 10/1993 | Lustig et al. | 426/127 |
| 5,281,027 | A | | 1/1994 | Thrall | 383/88 |
| 5,302,402 | A | | 4/1994 | Dudenhoeffer et al. | 426/129 |
| 5,310,587 | A | | 5/1994 | Akahori et al. | 428/35.2 |
| 5,328,705 | A | | 7/1994 | Wilhoit et al. | 426/113 |
| 5,360,648 | A | * | 11/1994 | Falla et al. | 428/35.2 |
| 5,372,429 | A | * | 12/1994 | Beaver, Jr. et al. | 383/109 |
| 5,376,439 | A | * | 12/1994 | Hodgson et al. | 428/220 |
| 5,405,561 | A | | 4/1995 | Dais et al. | 264/40.1 |
| 5,419,448 | A | | 5/1995 | Watson | 220/4.28 |
| 5,779,894 | A | | 7/1998 | Martensson | 210/232 |
| 5,803,256 | A | | 9/1998 | Lydhig et al. | 206/440 |
| 5,804,265 | A | * | 9/1998 | Saad et al. | 428/35.2 |
| 5,911,508 | A | | 6/1999 | Dobreski et al. | 383/5 |
| 5,965,224 | A | | 10/1999 | Chen et al. | 428/35.2 |
| 5,988,879 | A | | 11/1999 | Bredderman et al. | 383/13 |
| 6,065,873 | A | | 5/2000 | Fowler | 383/104 |
| 6,156,363 | A | | 12/2000 | Chen et al. | 426/410 |

FOREIGN PATENT DOCUMENTS

| | | | | | |
|---|---|---|---|---|---|
| FR | 1.067.272 | | | 7/1954 | |
| FR | 1.436.217 | | | 3/1966 | |
| GB | 2097361 | A | | 11/1982 | |
| GB | 2 228 724 | A | * | 9/1990 | |
| GB | 2228724 | A | * | 9/1990 | B65D/30/08 |
| GB | 2273488 | A | | 6/1994 | |
| IT | 339640 | | | 4/1936 | |
| JP | 1-240451 | | | 9/1989 | |
| JP | 1-267162 | | | 10/1989 | |
| JP | 1294-473 | A | | 11/1989 | |
| JP | 3-226475 | | | 10/1991 | |
| JP | 3-289450 | | | 12/1991 | |
| JP | 3289-470 | A | | 12/1991 | |
| JP | 3-289474 | | | 12/1991 | |
| JP | 4-31284 | | | 2/1992 | |
| JP | 5-338639 | | | 12/1993 | |
| NL | 8602-848 | A | | 6/1988 | |
| WO | WO 95/18754 | | | 7/1995 | |

OTHER PUBLICATIONS

Jenkins & Harrington, "Packaging Foods With Plastic," J. of Plastic Film & Sheeting, pp. 109–121, 143–147 & 305 (1991).

U.S. Dept. of Agriculture, "Home Freezing of Fruits and Vegetables," Home and Garden Bulletin No. 10 (1969).

ZIPLOC® Freezer Bags For Meat, an example of a visual concept evaluated by consumers (1995).

Webster's Third New international Dictionary, p. 1486.

EM Material Safety Data, Polymer Films Inc. (Jun. 1986).

* cited by examiner

FREEZER STORAGE BAG

BACKGROUND

This invention primarily concerns the packaging of food, particularly meat but is applicable to packaging other articles or items. The invention was made during attempts to make improved "freezer bags" for repackaging and freezer storing uncooked red meat by the "consumer" in a manner that reduces so called "freezer burn". However, various aspects of the invention also apply to the "commercial" packaging or repackaging of food, such as by a supermarket or by butchers at a slaughterhouse. Other aspects of the invention include methods for preparing the improved freezer bags; methods for using the bags; the packages of meat; and certain types of thermoplastic film being particularly suitable for use as meat-contacting packaging material.

Reclosable Plastic Storage bags are extremely old in the art. Today, plastic bags are typically available to the public in cartons identified for specific recommended "end use" (such as Storage Bags, Heavy Duty Freezer Bags, Vegetable Bags, Trash Bags). Often the bag itself is labeled by "end use", for example, "ZIPLOC® BRAND Heavy Duty Freezer Bags".

The term "Freezer Bag" is hereby defined as a bag having significant functional utility in the storage of food in a freezer. "Freezer Bags" are typically available in the following sizes: 2 gallon (7.6 L); 1 (3.8 L) gallon; pleated ½ gallon (1.9 L); quart (0.9 L); and pint (0.5 L).

The term "Freezer Burn" is hereby defined as the name for the dehydration that occurs when unpackaged or improperly packaged food is stored in the low humidity atmosphere of a freezer (see "Packaging Foods With Plastics", by Wilmer A. Jenkins and James P. Harrington, published in 1991 by Technomic Publishing Co., Inc., at page 305).

Freezer burn has remained a major complaint among consumers despite the commercial success of thick plastic freezer bags. In the short-term, freezer burn can be a reversible process. In the long-term, however, freezer burn causes a complex deterioration of food quality involving undesirable texture changes followed by chemical changes such as degradation of pigments and oxidative rancidity of lipids. Taste, aroma, mouth feel and color can all be ruined. Freezer burn of raw red meat is particularly critical because of its impact upon the color of the meat.

Aforementioned "Packaging Foods With Plastics" provides an excellent state of the art summary, with all the information on (commercial) "packaging fresh red meat collected in Chapter Seven". Curiously, the book does not appear to mention freezer burn, apart from defining it in the glossary.

"Keeping Food Fresh" is the title of an article in "Consumer Reports", for March, 1994, at pages 143–147. The article is too recent to be available as prior art to the extent that this application designates the United States. Nevertheless its contents are of interest in showing the absence of certain types of prior art, and therefore enhancing the patentability of the present invention.

The "Consumer Reports" article attempts to answer the question as to which packaging material (plastic, aluminum, waxed paper, bags, wraps or reusable containers) do the best job of (1) keeping food fresh for "the long haul", (2) at lowest overall cost, and (3) with minimum adverse environmental impact. It "top rates" ZIPLOC® Pleated Freezer Bags (at page 145). It points out that food stored in plastic containers can suffer from freezer burn if the container contains too much air. Concerning "wraps" (plastic films and freezer papers) it advised against double wrapping because of cost and environmental reasons and "our tests showed that double wrapping doesn't afford much extra protection anyway". Nowhere does the article disclose or suggest the invention described hereinafter.

The patent literature contains descriptions of various types of bags having liners or double walls including some space between the walls. Some of these patents relate to the transportation and storage of food. U.S. Pat. No. 4,211,091 (Campbell) concerns an "Insulated Lunch Bag". U.S. Pat. No. 4,211,267 (Skovgaard) describes a "Carrying Bag" for "getting home with frozen food before it thaws". U.S. Pat. No. 4,797,010 (assigned to Nabisco Brands) discloses a duplex paper bag as a "reheatable, resealable package for fried food". U.S. Pat. No. 4,358,466 (assigned to The Dow Chemical Company) relates to an improved "Freezer To Microwave Oven Bag". The bag is formed of two wing shaped pouches on each side of an upright spout. U.S. Pat. No. 5,005,679 (Hjelle) concerns "Tote Bags Equipped With A Cooling Chamber". All of these food bags appear to have very thick food contacting walls compared to the invention described hereinafter. None of these patents appear to focus on freezer burn.

Books on "Home Freezing" are of interest to this invention. Concerning "Wrapping Meat for the Freezer", the book "Rodale's Complete Book of Home Freezing" by Marilyn Hodges and the Rodale Test Kitchen staff (1984) suggested the inconvenient method of wrapping meat chunks in a single layer of freezer paper and "sucking out the air with a straw" (trying to avoid getting blood into ones mouth) in order to reduce the amount of dehydration in the freezer (see page 173).

There is clearly still a great need to improve existing methods of packaging fresh meat, as determined by consumer surveys, coupled with the fact that there is a 45 billion dollar retail market in the U.S. alone, consuming about 225 million dollars worth of plastic packaging materials annually.

SUMMARY OF THE INVENTION

In contrast to the known prior art, it has now been surprisingly discovered that certain types of multiple walled plastic bags (defined herein as "multibags") are better than corresponding single wall freezer bags (having equal or greater weight than the multiple walled bags) for use as a functional freezer bag for preserving red meat without freezer burn. All of the independent claims hereinafter concern different but related broad aspects of the invention, and are hereby incorporated by reference.

DETAILED DESCRIPTION OF THE INVENTION

Figure 1A:
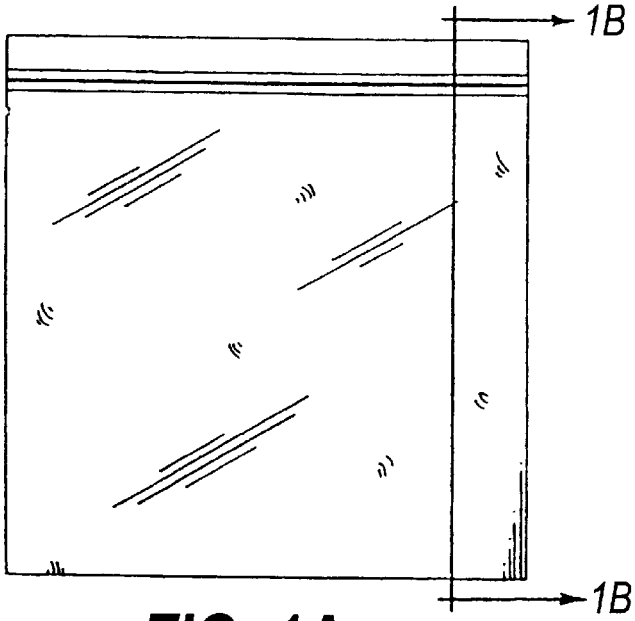
FIG. 1A (PRIOR ART)
FIG. 1A is a front elevational view of a prior art reclosable thermoplastic single wall bag having a zipper.
Figure 1B:
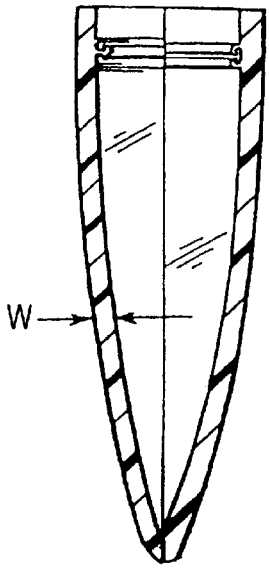
FIG. 1B (PRIOR ART)
FIG. 1B is a cross-sectional view taken along reference line 1B—1B of FIG. 1A.

According to a first aspect of the invention, there is provided a freezer bag comprising a multibag of at least two bags, the first bag being the innermost, that is, (hereinafter "liner"), the second bag (hereinafter "support") surrounding the liner, the support bag having a mouth and a throat, and the liner bag having a mouth, and a mouth-seal connecting the liner's mouth to the support's throat, characterized in that:

the liner is thermoplastic and has a thickness (t) of less than 2.0 mil (50 micron).

According to a second aspect, there is provided a multi bag of at least two bags, the first bag being both thermoplastic and the innermost bag (hereinafter "liner") the second bag (hereinafter "support") surrounding the liner, the support bag having a mouth and a throat, and the liner bag having a mouth, and a mouth-seal connecting the liner's mouth to the support's throat characterized in that:

the mouth-seal is a blanket heat seal.

In a third aspect, the present invention provides a multibag of at least two bags, the first bag being the inner most (hereafter "liner"), the second bag (hereinafter "support") surrounding the liner and, the support bag having a mouth and a throat, and the liner bag having a mouth, and a mouth-seal connecting the liner's mouth to the support's throat, characterized in that the liner is textured.

The present invention also provides thermoplastic non-halogenated film for use as meat-contacting packaging material, characterized by the combination:

(i) the film has a thickness (t) of less than 2 mil (50 $\mu$m);

(ii) the film has a Transverse Direction 2 percent Secant Modulus (TDSM) of less than 40,000 psi/100 percent extension ($1.86\times10^8$ Pa/100 percent extension) when determined in accordance with ASTM D 882-83 (Standard Test methods for Tensile Properties of Thin Plastic Sheeting), Method A with a jaw gap of 4 inches (10 cm) for test specimens having an initial width of 1 inch (2.5 cm), except that the Initial Strain Rate is 0.25 inches per inch per minute (0.25 cm per cm per minute) with a crosshead speed of 1 inch (2.5 cm) per minute;

(iii) the film has a calculated value, Z-value of less than 20,000 $mil^3$ psi (2.25 $mm^3\cdot kPa$)/100 percent extension wherein Z-value equals $(t^3)\times(TDSM)$;

(iv) at least one surface of the film has a contact angle in a range of from 65° to 75° at room temperature (20° C.) relative to raw beef meat juice, as determined by Advancing Contact Angle Determination with a Contact Goniometer (A-100 Ráme-Hart); and (v) the film is an embossed film.

Further, the invention provides a process for preparing reclosable thermoplastic bags by the steps of (a) forwarding a first thermoplastic film having a thickness greater than 1 mil (25 $\mu$m) and having mateable male and female closure elements along opposed edges of the thermoplastic film; (b) folding the film and mating the male and female closure elements; (c) seal cutting to length in the machine direction to form bags, and stacking and packing the bags, characterized by the additional steps of:

(d) In parallel with step (a), forwarding a sheet of thermoplastic film having a thickness (t) of less than 2 mil (50 $\mu$m);

(e) Prior to step (b) overlaying and aligning the second thermoplastic film onto the first thermoplastic film between the male and female closure elements;

(f) Still prior to step (b), heat-sealing the second thermoplastic film to the first thermoplastic film at two locations, adjacent to and between the male and female closure elements; and, (g) In step (c), seal cutting to form a common edge seal between the liner bag and support bag.

The invention also provides aged frozen freezer bagged beef having a frozen age of at least 6 months and having metmyoglobin (MMb) at the beef's surface; characterized in that:

The amount of MMb at the surface of the beef is less than 60 percent of the total myoglobin content as determined by a conventional absorption spectrophotometry test.

Certain terms used in this specification are hereby defined as follows:

"Multiwall (noun)" is a "multiwall bag" (in accordance with Webster's "complete" dictionary at page 1486);

"Multiwall (adjective)" is "having a wall made-up of several layers" (in accordance with Websters "complete" dictionary at page 1486).

A "double bag" is two bags, one within the other, which double bag can be separated into two separate bags, which separate bags can then reform the double bag (as for bagging groceries at a supermarket).

A "duplex bag" is hereby defined as an integral bag consisting of an outer support bag and an inner liner bag, wherein the liner bag is partly (but not completely) joined to the support bag.

A "multi bag" is hereby defined as an integral bag having at least an outer support bag and an inner liner bag, wherein the liner bag is partly (but not completely) joined to the support bag; and optionally additional layers between the liner bag and the support bag. The simplest form of a multibag is a duplex bag. The term "multibag" does not appear in Webster's Dictionary.

The liner bag of the freezer bag of the invention preferably has a Transverse Direction 2 percent Secant Modulus (TDSM) of less than 40,000 (preferably less than 27,000) psi/100 percent extension ($1.86\times10^8$ Pa/100 percent extension) when determined in accordance with ASTM D 882-83 (Standard Test Methods for Tensile Properties of Thin Plastic Sheeting), Method A with a jaw gap of 4 inches (10 cm) for test specimens having an initial width of 1 inch (2.5 cm), except that the Initial Strain Rate is 0.25 inches per inch per minute (0.25 cm per cm per minute) with a crosshead speed of 1 inch (2.5 cm) per minute. When TDSM has a value less than 27,000 units, such products are typically prepared by so-called well known cast-film processes. When TDSM has a value in a range of 27,000 to 40,000 units, such products are typically prepared by well know blown-film proesses. Such liners suitably comprises thermoplastic film having a calculated value, Z-value, of less than 60,000 $mil^3$ psi (6.75 $mm^3$ kPa)/100 percent extension wherein Z-value equals $(t^3)\times$(TDSM). Preferably, the liner's Z-value is less than 20,000 $mil^3$ psi (2.25 $mm^3\cdot$kPa)/100 percent extension; especially in a range from 2,000 to 10,000 $mil^3$ psi (0.2 to 1.1 $mm^3\cdot$kPa); and most preferably in a range from 3,000 to 6,000.

Suitably the thermoplastic film comprises homopolymers and copolymers of ethylene having a specific gravity of less than 0.930 gm/cc.

In a preferred embodiment, the multibag consists of 2 bags and wherein the support has a Z-value in a range of 50,000 to 150,000 $mil^3$ psi (5.6 to 16.9 $mm^3\cdot$kPa)/100 percent extension.

Thickness of films (t and T) are easily determined by conventional spacing loaded thickness gauges.

Advantageously, the liner's food contactable surface has a contact angle in an amount from 65° to 75° at room temperature (20° C.) relative to raw beef meat juice, as determined by Advancing Contact Angle Determination with a Contact Goniometer (A-100 Ráme-Hart). The liner's food contactable surface suitably has been corona-treated. Usually, the liner's thickness (t) will be in a range of 0.3 to 1.0 mil (8 to 25 $\mu$m); preferably 0.5 to 0.7 mil (12 to 18 $\mu$m) and the support bag's thickness (T) will be in a range from 1.0 to 4.0 mil (25 to 100 $\mu$m); preferably from 1.3 to 3.0 mil (35 to 75 $\mu$m); and more preferably from 1.5 to 2.0 mil (40 to 50 $\mu$m). However, other thickness can be used.

Suitably, the support bag is thermoplastic.

Usually, the freezer bag will have a liquid storage capacity in a range of 1 pint to 2 gallons. The space between the liner bag and the support bag can be vented to atmosphere outside the support; essentially unvented and containing constant mass of material; or vented to the space within the liner bag. In the latter option, the seal between the support bag's throat and the liner bag's mouth suitably is discontinuous and the space between the liner and the support comprises hygroscopic material. Preferably, the hygroscopic material is selected from hydroxypropyl methylcellulose and polyvinyl alcohol. The liner bag can be connected to the support bag by common edge seats or the liner bags edge seals can be separate from the support-bags's edge seals.

The support bag may comprise mateable male and female closure elements along opposed inner surfaces of the support bag. The liner bag can have a color or texture that is different from the color or texture of at least part of the support bag. It is particularly preferred that the liner bag is textured, for example, embossed. It has been found that liner film having an embossed surface has greater cling to raw red meat as determined by a static coefficient of friction test analogous to that described in ASTM D 1894-87. When the liner bag is textured the upper thickness limitation of the first embodiment is not applicable. Thicknesses of up to 3.0 mil may be used when the liner's film is embossed.

Preferably, the connection between the liner bag and the support bag is such that the liner can be stroked to conform to the external geometry of a ribeye steak placed within the liner bag.

The multibags can have more than two layers. For example, it can have three layers and in this embodiment it is preferred that the third layer is located between the liner bag and the support bag and causes the liner bag to be conformable to the outside geometry of food within the liner bag while food in the bag is being frozen. Suitably, the liner's thickness (t) is in a range from 1.0 to 2.0 mil (25 to 50 $\mu$m), and the third bag is formed of elastic fabric.

It is preferred that the support bag is sealed to the liner bag by a "mouth seal" that is a "blanket heat seal," preferably an "extruded heat seal." By "extruded blanket seal", we mean a blanket seal that is extruded directly onto the overlapped liner film and support film. However, the mouth-seal can also be made by using (i) conventional hot melt adhesion between the liner and the support; or (2) conventional hot press sealing; or even some form of solvent sealing.

EXAMPLES OF THE INVENTION

The experimental work that led to the aspects of the invention claimed hereinafter involved time-consuming hand fabrication of numerous different types of "multibag" defined above; repackaging of meat in the multibags; and evaluation of the performance of the multibags relative to each other and other controls being commercially available freezer bags, during and after many months of storage in a freezer.

The experimental work involved the sequential evaluation of three main types of prototype, types A, B, and C described below.

Type-A Prototypes

Figure 5A:
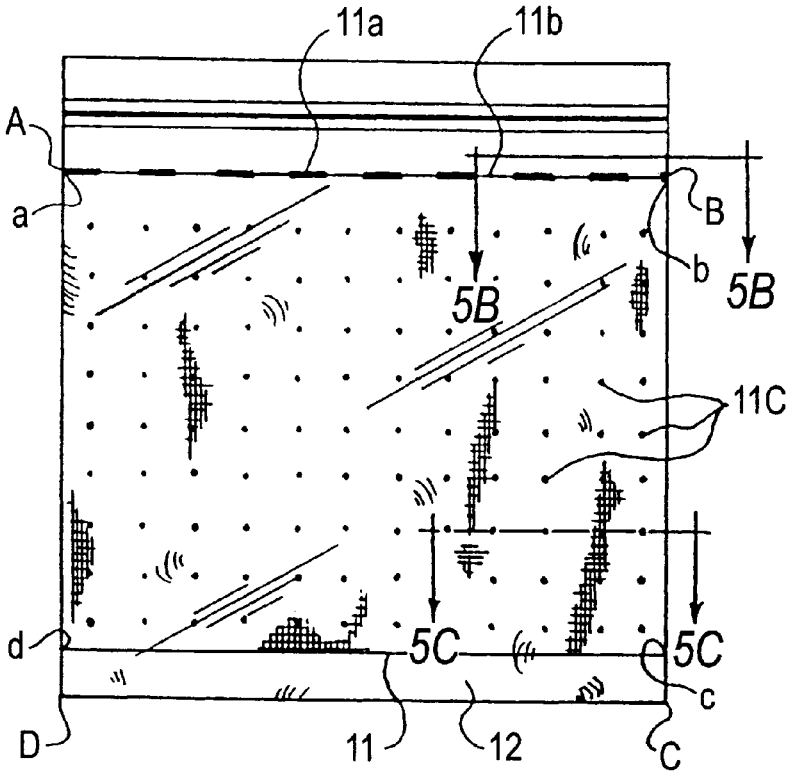
FIG. 5A is also a front elevational view of a double wall bag of the present invention, with the space between the inner and outer walls connected to the space within the inner bag.
Figure 5B:
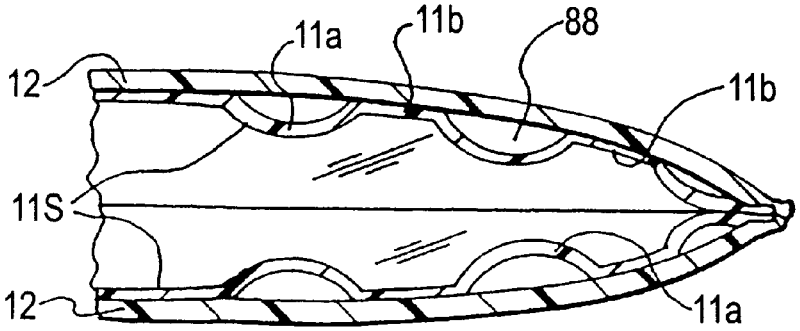
FIG. 5B is a partial cross-sectional view along line 5B—5B of FIG. 5A.
Figure 5C:
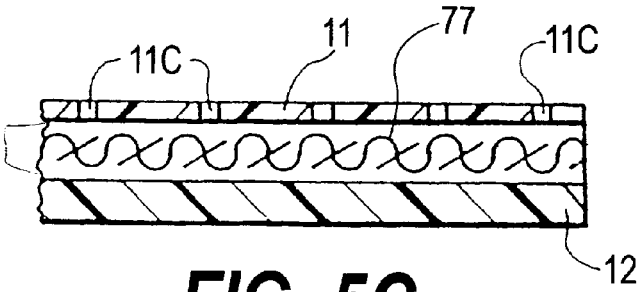
FIG. 5C is a partial cross-sectional view along line 5C—5C of FIG. 5A.

Type-A prototypes were all three-layer multibags made essentially in accordance with FIGS. 5A, 5B and 5C having a support bag (12), a liner bag (11), a third layer (77), and vent holes (11*c*) for venting the space between the liner bag and the support bag to the space within the liner bag.

More specifically, Type-A1 multi bags were fabricated as follows:

a. A support bag (12) being an outer layer of polyethylene film (used for making ZIPLOC® storage bag 1.75 mil (45 $\mu$m);

b. A liner bag (11) being an inner layer of polyethylene film 1.75 mil (45 $\mu$m) thick with 800 microholes (11*c*) having hole diameters of 10 $\mu$m as vent holes to permit moisture to move freely into and out of the middle layer; and c. A third layer (77) being a hygroscopic film having a thickness of 1.5 mil (38 μm) and moisture content of around 10 percent by weight (METHOCEL® cellulose ethers film made by Polymer Films, Inc.-Rockville, Conn.). METHOCEL® is a registered Trademark of The Dow Chemical Company. More specifically, typical properties of the film are found in the June, 1986 data sheet of Polymer Films Inc., for the product named "EM IIDO Water Soluble Film". The product was identified as having the primary constituent being Hydroxypropyl Methyl Cellulose Resin having CAS No of 009004-65-3.

Further, it will be noted from FIG. 5A that the edge seals AD and BC of the support bag (12) are essentially "common" with the edge seals ad and bc of the liner bag (11).

Type-B Prototypes

Type-B prototypes were all three-layer multibags essentially similar to the Type-A prototypes except that the liner bag (11) had a thickness of 1.2 mil (30 μm) (instead of 1.75 mil (45 μm)); and except the liner (11) had no microholes therein and that the space between the liner bag and the support bag was essentially completely unvented.

Type-C Prototypes

Type-C prototypes were all multibags of the duplex variety as shown in FIGS. 2A, 2B, 2C, 3A, 3B, 3C, 4A, 4B and 4C and having a support bag (12) having a thickness of 1.75 mil (45 μm) and a liner bag (11) having a thickness of 0.6 mil (15 μm) without any "third layer or wall" between the liner bag and the support bag. The mouth seal AB between the liner's mouth and the support's throat was a hot press seal rather than the blanket seal 55 shown in FIGS. 2A, 2B and 3A and 3B.

The Type-C multibags were given a secondary classification (denoted by the letter "C" or the letter "S" dependent upon whether the bags had "common edge seals" or "separate edge seals". The liner's edge seals are shown on the lines ad and bc in FIGS. 2A, 3A and 4A. The edge seals of the support bag (12) are shown by the lines AD and BC in FIGS. 2A, 3A and 4A. Clearly, in FIG. 2A the edge seals are essentially "common"; whereas in FIGS. 3A and 4A the edge seals are "separate".

Figure 7:
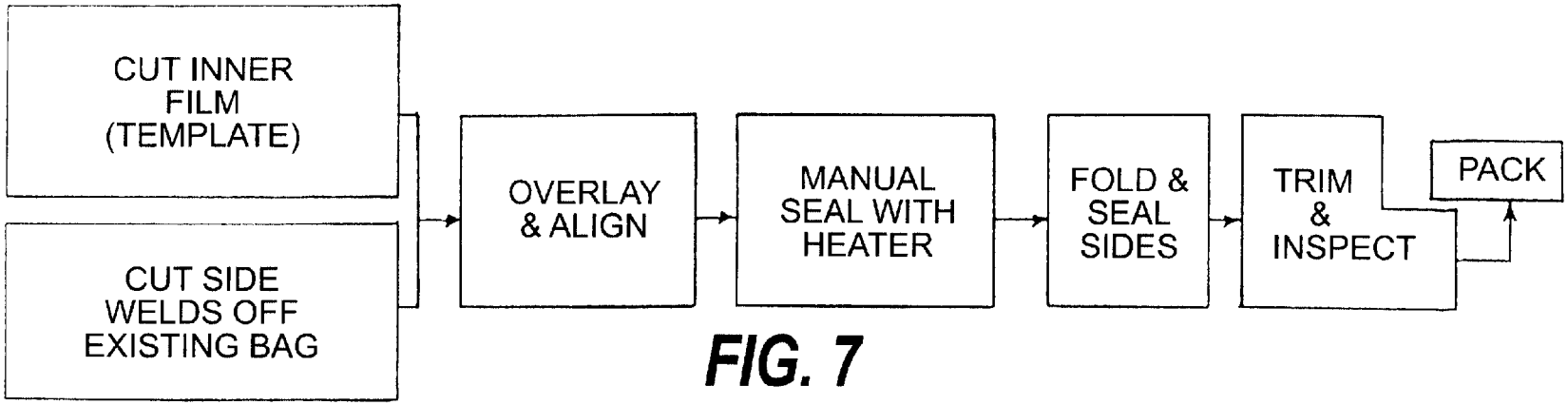
FIG. 7 is a diagrammatic flow diagram for one manual process of the present invention for making experimental freezer bags.
Figure 8:
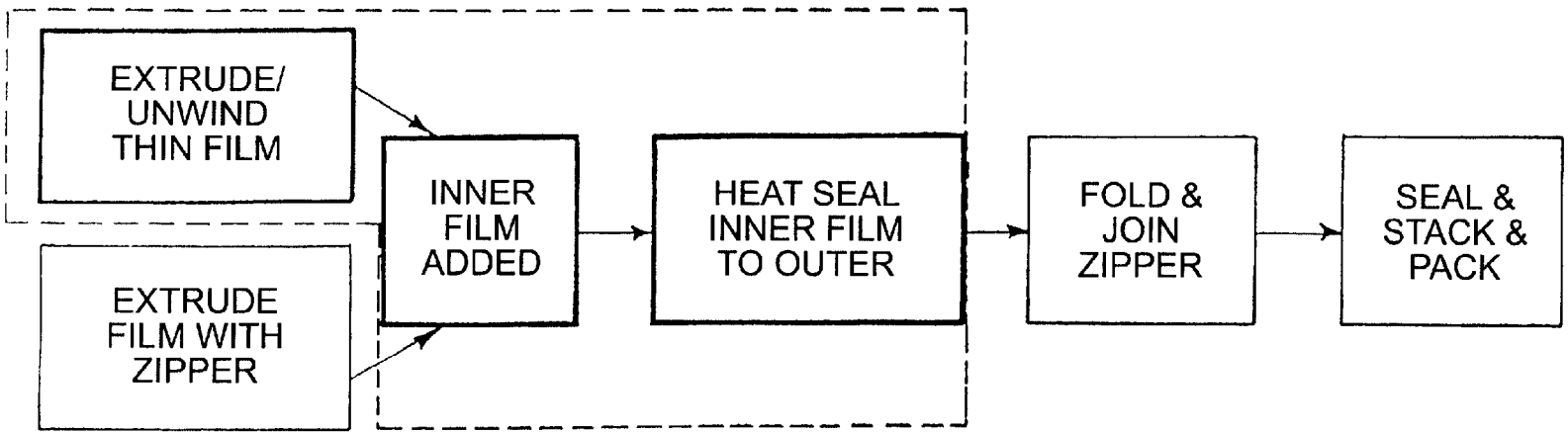
FIG. 8 is a diagrammatic flow diagram for a process of the present invention for making freezer bags (with a common edge seal between the liner bag and support bag).
Figure 9A:
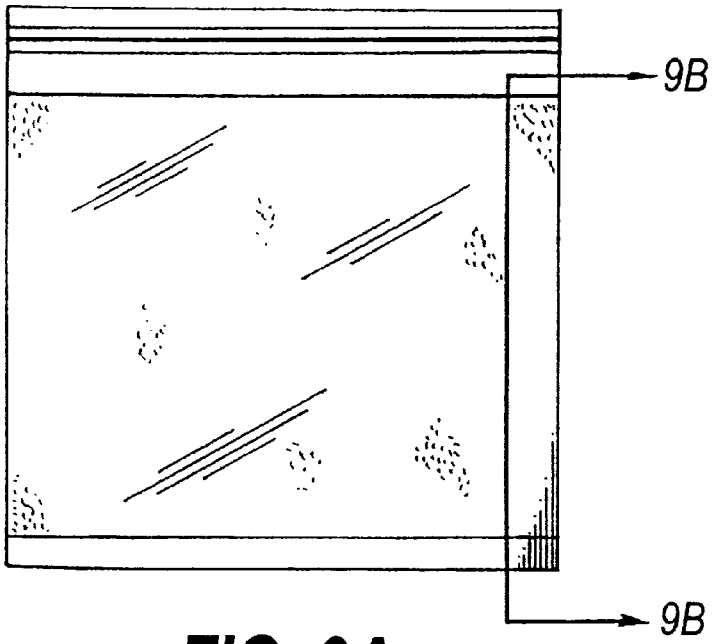
FIG. 9A is a front elevational view of a double wall bag in accordance with the present invention, having a liner bag prepared from textured, particularly embossed film on at least the inside surface 11S.
Figure 9B:
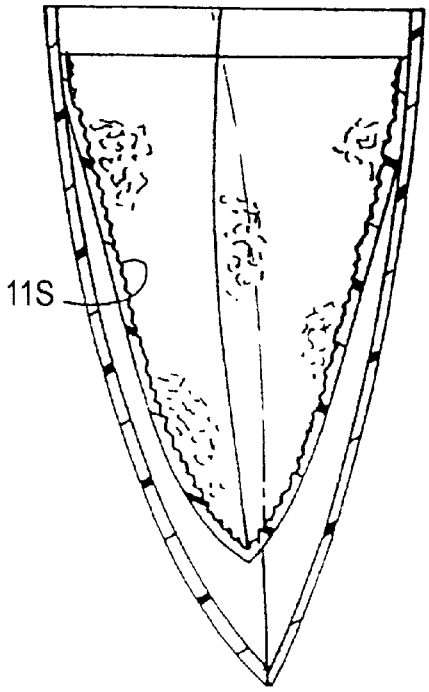
FIG. 9B is a cross-sectional view taken along reference line 9B—9B of FIG. 9A.

The bags were fabricated by hand. FIG. 7 is a diagrammatic flow diagram for making Type-CC multi bags.

Figure 2A:
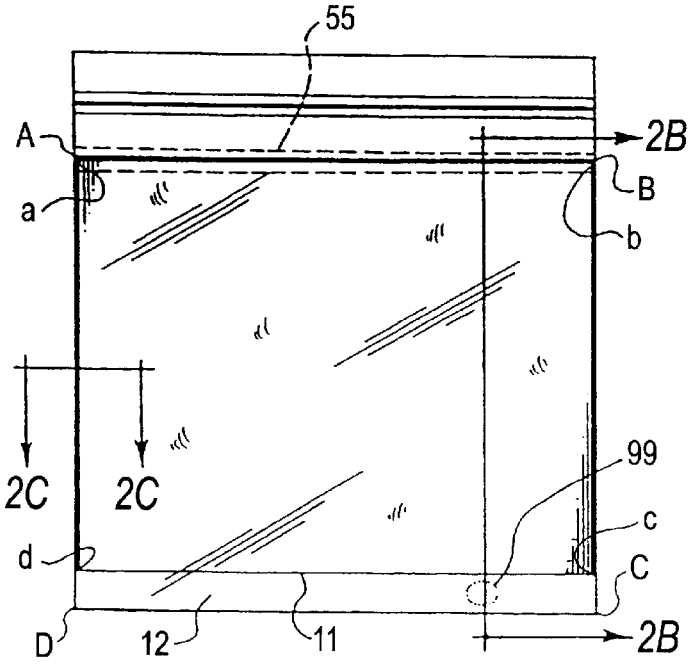
FIG. 2A is a front elevational view of a double wall bag in accordance with the present invention, (i) having a thin inner wall or liner, and (ii) having "common side seals" between the inner and outer walls and, optionally, (iii) a vent through the outer wall to connect the space between the inner and outer walls to the atmosphere outside the outer wall; and mouth seal that is optionally a blanket heat seal.
Figure 2B:
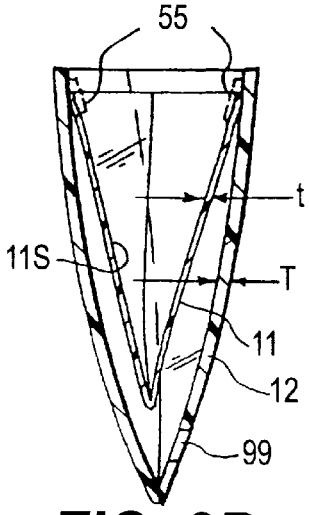
FIG. 2B is a partial cross-sectional view taken along line 2B—2B of FIG. 2A.
Figure 2C:
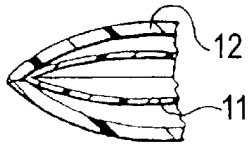
FIG. 2C is a partial cross-sectional view taken along line 2C—2C of FIG. 2A.
Figure 3A:
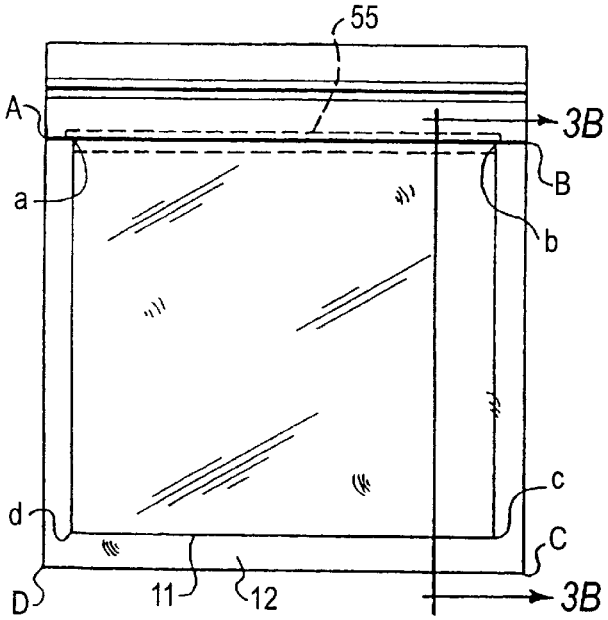
FIG. 3A is a front elevational view of another double wall bag of the present invention, with "separate side seals".
Figure 3B:
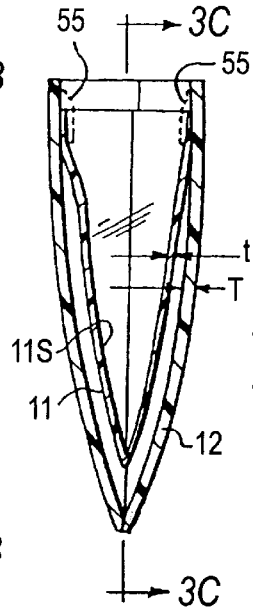
FIG. 3B is a partial cross-sectional view taken along line 3B—3B of FIG. 3A.
Figure 3C:
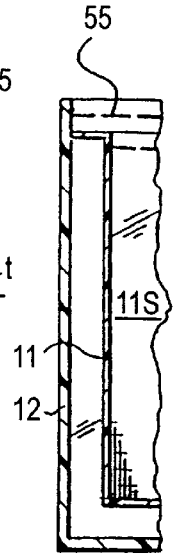
FIG. 3C is a cross-sectional view taken along line 3C—3C of FIG. 3B.
Figure 4A:
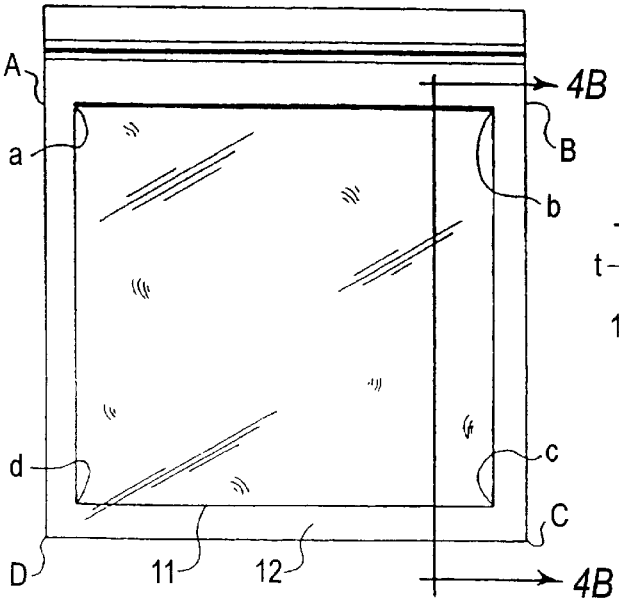
FIG. 4A is a front elevational view of a further double wall bag of the present invention, with the space between the inner and outer walls connected with the space within the inner bag.
Figure 4B:
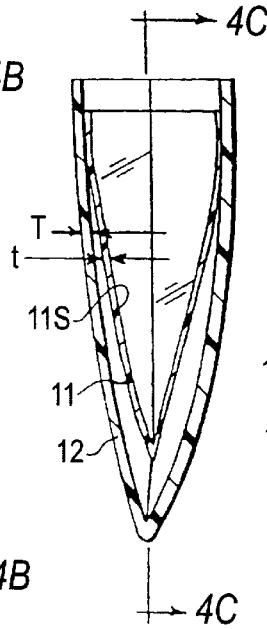
FIG. 4B is a partial cross-sectional view taken along line 4B—4B of FIG. 4A.
Figure 4C:
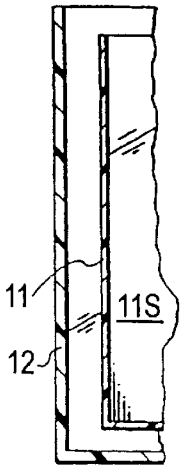
FIG. 4C is a partial cross-sectional view taken along line 4C—4C of FIG. 4B.

The Type-C multibags were given a tertiary classification (1, 2, or 3) according to whether the space between the support bag (12) and the liner bag (11) was (1) vented to the space within the liner bag (as shown in FIG. 4C); or (2) not vented (as shown in FIGS. 3A, 3B and 3C); or (3) vented to the surrounding atmosphere (as shown by the vent (99) in dotted line in FIGS. 2A and 2B).

The Type-C multibags could be given a fourth clarification dependent upon whether the "mouth seal" is merely a "simple hot press seal" (hereinafter SHPS) "not simple hot press seal" (hereinafter NSHPS).

Figure 10:
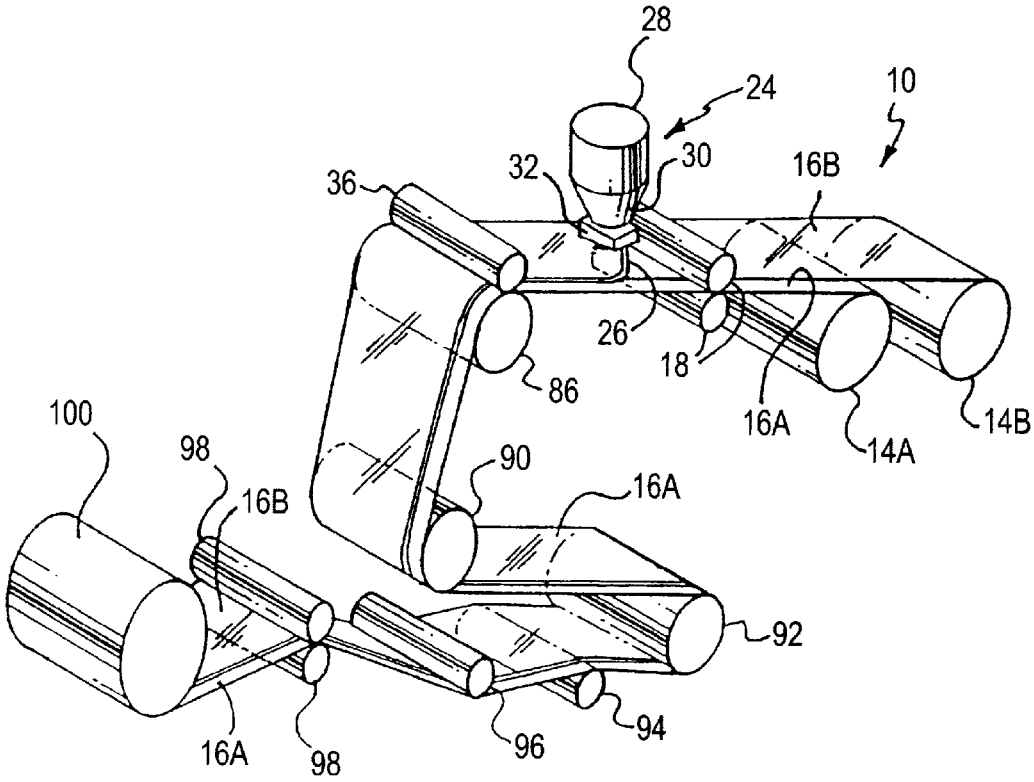
FIG. 10 is an isometric view of one process for preparing mouth seals that are extruded blanket seals.

Examples of NSHPS include both "hot melt adhesion" and "blanket heat seal" (hereinafter BHS) particularly wherein a blanket strip is extruded onto both the inner mouth of the liner and the inner throat of the support (hereinafter EBHS). One possible EBHS process is illustrated in FIG. 10. EBHS permits high speed.

Evaluation Procedure

All prototype multibags were essentially evaluated relative to control bags in the following way by actually using the bags as potential freezer bags containing boneless beef steak.

1. Beefsteak samples were initially weighed before packing in the bags. Each bag had one beef steak. The bags were placed in a commercial freezer with a set point of 0° F. (−18° C.).

2. The freezer was occasionally opened and closed for the purpose of observing the samples.

3. Physical observation (including bags conformation around steaks, formation of ice crystals, visible dry spots, and discoloration) were made daily during the first two weeks and then once every week for the next eight months for prototypes Type-A and Type-B. Type-C was physically observed over a period of three months. Frozen beef steaks were photographed in color both inside and outside the bags, then thawed and photographed again.

4. Percent weight loss and the amount of drips were measured on the thawed steaks. Amount of drips is defined as the blood-like fluid exuding from frozen meat upon thawing.

5. "Unexpected effects" were noted as appropriate.

Short Term Results—Types A, B and C

Various Type-A prototypes and Type-B prototypes were evaluated simultaneously, and sequentially in a staggered manner.

Type-A1 described above was evaluated because the film was hygroscopic and in the hope that it might help to prevent moisture escaping from the meat during storage in the freezer.

However, an unexpected result occurred almost immediately. In particular it was discovered that, with a hygroscopic film layer between the liner bag and the support bag, the hygroscopic layer and the liner bag changed shape very rapidly and "conformed" to the shape of the beef steak. In other words it was highly beneficial in excluding air from the space around the beef steak.

It came as a second major surprise when the Type-B multibag also tightly conformed the liner bag around the steak as a short-term phenomenon.

Figure 6A:
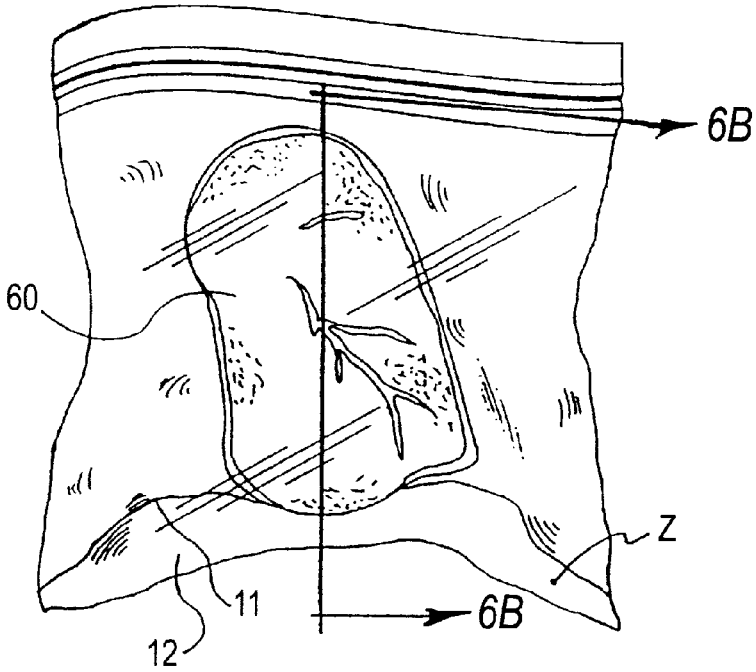
FIG. 6A is a front elevational view of a package of "meat in a closed bag" of the invention.
Figure 6B:
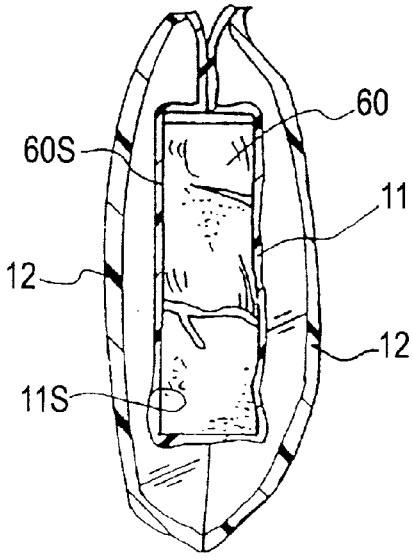
FIG. 6B is a cross-sectional view taken along reference line 6B—6B of FIG. 6A.

The apparent success of the Type-B multi bag led to the design of the Type-C multi bag. Two types of Type-C bags were evaluated: Type-CC2 and Type-CS2. Again a surprisingly result occurred. The Type-CC2 multibag appears to conform more easily to the shape of the beef steak at packaging and "before" the beef steak package is placed in the freezer as shown in FIG. 6A. With hindsight, it is possible to make various speculations based upon the fact that the unvented bag essentially has constant mass of air between the liner bag and the support bag.

Long-Term Results—Types A and B

Beef steaks in regular freezer bags (control) developed many large ice crystals and severe discoloration (bright red color faded into faint brown). Severe freezer burn, as evidenced by large discolored dry spots, was observed on the steak in both frozen and thawed states.

Beef steaks in the Type-A three-layer multibags (with a perforated inner layer) were in excellent condition. Formation of ice crystals was significantly reduced, the bright red color was maintained and no discoloration was observed. No freezer burn on the surface of the steaks was observed.

The Type-B three-layer multibags with nonperforated film as the inner layer showed similar results to those obtained with Type-A multi bags.

A key hindsight observation that may explain the significant difference in quality performance between the control bags and the three-layer bags is that the middle and inner layers of the three-layer bags had tightly conformed around the steak which resulted in reducing air pockets and subsequent formation of ice crystals.

A comparison of weight loss and amount of drips between treatments showed that weight loss of the steaks correlated well with the amount of formation of ice crystals. Beef steaks stored in regular freezer bags had a severe weight loss (up to 20.5 percent) in eight months and the amount of drips was 2.06 percent. Beef steaks stored in the three-layer bags (with a perforated inner layer) had a significantly less weight loss (4.3 percent) than the control and the amount of drips was 1.93 percent. The least amount of weight loss (1.9 percent) and drips (0.26 percent) was measured with steaks stored in the three-layer bags (with nonperforated inner layer). The difference in performance between the three-layer bags and control bags relate to the ability of the three-layer bags to conform tightly around the meat, which led to minimizing air pockets. As a result of conforming, the dehydration process, that leads to freezer burn, was reduced significantly.

It was concluded that the quality of frozen beef steaks, stored in the Type-A and Type-B three-layer multibags was superior compared to regular freezer storage bags (control). The freezer burn was minimized significantly due to the conforming of the inner and middle layers of the three-layer bags onto the beef steaks.

Long-Term Results—Type-C

The Type-CC2 and Type-CS2 multibags also performed significantly better than the commercially available freezer bags used as control. Their superior performance can be attributed, with the benefit of hindsight, to the tendency of the liner bag to "conform" to the food and minimize the headspace available for ice formation. It should perhaps be noted that performance advantages of these prototypes were less significant in tests with irregularly shaped food such as broccoli and chicken with bones.

Various properties of the Type-C liner bag and support bag were measured and compared with the corresponding properties of the commercially available freezer bags. For example, Relative Stiffness, as determined by the Dow-Brands Relative Flexural Stiffness in the Transverse Direction of the Type-C liner was 1 to 2 orders of magnitude lower than commercially available "freezer bags" (for example, 5,300 psi cubic mils compared with 304,000 psi cubic mils) (34 kPa/mm$^3$).

What is claimed is:

1. A recloseable multibag freezer bag comprising:

an inner liner bag defining an inner wall of the multibag, the liner bag having a mouth through which an interior of the liner bag is accessible, the liner bag being formed of a thermoplastic film having a thickness t of less than 2.0 mil and having a Transverse Direction two percent Secant Modulus (TDSM) of less than 40,000 psi/100 percent extension when determined in accordance with ASTM D 882-83 (Standard Test methods for Tensile Properties of Thin Plastic Sheeting), Method A with a jaw gap of 4 inches for test specimens having an initial width of 1 inch, except that the Initial Strain Rate is 0.25 inches per inch per minute with a crosshead speed of 1 inch per minute;

an outer support bag surrounding the liner bag and defining an outer wall of the multibag, the support bag being formed of a thermoplastic film, and having a mouth and a throat, the liner bag mouth being joined by a mouth seal to the throat of the support bag along the entire length of the liner bag mouth to form a substantially enclosed air space between the liner bag and the support bag; and a recloseable mouth seal affixed to the mouth of the support bag to provide recloseable access to the interior of the liner bag through the mouth of the support bag while maintaining the enclosed air space between the liner and support bags.

2. The freezer bag according to claim 1, wherein the film of the liner bag is formed of a material selected from the group consisting of homopolymers and copolymers of ethylene having a specific gravity of less than 0.930 gm/cm$^3$.

3. The freezer bag according to claim 1, wherein the film of the support bag has a thickness T in a range from 1.0 to 4.0 mil.

4. The freezer bag according to claim 1, wherein the liner bag and at least part of the support bag differ from one another in at least one of color and texture.

5. The freezer bag according to claim 1, wherein the film of the liner bag has been corona-treated.

6. The freezer bag according to claim 1, wherein the recloseable mouth seal comprises recloseable closure elements disposed along opposed inner surfaces of the support bag.

7. The freezer bag according to claim 1, wherein the thickness t of the liner bag film is in a range from 0.3 to 1.0 mil.

8. The multibag of claim 1, wherein the liner bag is textured.

9. The freezer bag according to claim 1, wherein the mouth-seal is selected from a hot melt adhesion seal and a blanket heat seal.

10. The freezer bag according to claim 1, wherein the TDSM of the film of the liner bag is less than 27,000 psi/100 percent extension.

11. The freezer bag according to claim 1, wherein the enclosed air space between the liner bag and the support bag is vented to atmosphere outside the support bag.

12. The freezer bag according to claim 1, wherein the enclosed air space between the liner bag and the support bag is essentially unvented.

13. The freezer bag according to claim 1, wherein the enclosed air space between the liner bag and the support bag is vented to the interior of the liner bag.

14. The freezer bag according to claim 13, further comprising a hygroscopic material selected from hydroxypropyl methylcellulose and polyvinyl alcohol disposed within the enclosed air space between the liner bag and the support bag.

15. The freezer bag according to claim 1, further comprising an intermediate layer, located between the liner bag and the support bag, precipitating the liner bag to be conformable to the outside geometry of food within the liner bag while the food is being frozen.

16. The freezer bag according to claim 1, wherein the film of the liner bag has a calculated value, Z-value, which equals $(t^3)\times(\text{TDSM})$, of less than 60,000 mil$^3$ psi/100 percent extension.

17. The freezer bag according to claim 16, wherein the calculated value, Z-value of the film of the liner bag is less than 20,000 mil$^3$ psi/100 percent extension.

18. The freezer bag according to claim 16, wherein the calculated value, Z-value of the film of the liner bag is in a range between 2,000 and 10,000 mil$^3$ psi/100 percent extension.

19. The freezer bag according to claim 16, wherein the calculated value, Z-value of the film of the liner bag is in a range between 3,000 and 6,000 mil$^3$ psi/100 percent extension.

20. A recloseable multibag freezer bag comprising:

an inner liner bag defining an inner wall of the multibag, the liner bag being formed of a thermoplastic film having (i) a thickness t, (ii) a Transverse Direction two percent Secant Modulus TDSM determined in accordance with ASTM D 882-83 (Standard Test methods for Tensile Properties of Thin Plastic Sheeting), Method A with a jaw gap of 4 inches for test specimens having an initial width of 1 inch, except that the Initial Strain Rate is 0.25 inches per inch per minute with a crosshead speed of 1 inch per minute, and (iii) a calculated value, Z-value, which equals $(t^3)\times(TDSM)$, of less than 60,000 $mil^3$ psi/100 percent extension, the liner bag having a mouth through which an interior of the liner bag is accessible;

an outer support bag surrounding the liner bag and defining an outer wall of the multibag, the support bag being formed of a thermoplastic film and having a mouth and a throat, the liner bag mouth being joined by a mouth seal to the throat of the support bag along the entire length of the liner bag mouth to form a substantially enclosed air space between the liner bag and the support bag; and a recloseable mouth seal affixed to the mouth of the support bag to provide recloseable access to the interior of the liner bag through the mouth of the support bag while maintaining the enclosed air space between the liner and support bags.

21. The freezer bag according to claim 20, wherein the film of the liner bag is formed of a material selected from the group consisting of homopolymers and copolymers of ethylene having a specific gravity of less than 0.930 $gm/cm^3$.

22. The freezer bag according to claim 20, wherein the film of the support bag has a thickness T in a range from 1.0 to 4.0 mil.

23. The freezer bag according to claim 20, wherein the liner bag and at least part of the support bag differ from one another in at least one of color and texture.

24. The freezer bag according to claim 20, wherein the liner bag has been corona-treated.

25. The freezer bag according to claim 20, wherein the recloseable mouth seal comprises recloseable closure elements disposed along opposed inner surfaces of the support bag.

26. The freezer bag according to claim 20, wherein the thickness t of the liner bag film is in a range from 0.3 to 1.0 mil.

27. The multibag of claim 20, wherein the liner bag is textured.

28. The freezer bag according to claim 20, wherein the mouth-seal is selected from a hot melt adhesion seal and a blanket heat seal.

29. The multibag of claim 20, wherein the film of the liner bag is embossed, and the thickness t of the film of the liner bag is in a range of from 0.5 to 3.0 mil.

30. The freezer bag according to claim 20, wherein the calculated value, Z-value of the film of the liner bag is less than 20,000 $mil^3$ psi/100 percent extension.

31. The freezer bag according to claim 20, wherein the calculated value, Z-value of the film of the liner bag is in a range between 2,000 and 10,000 $mil^3$ psi/100 percent extension.

32. The freezer bag according to claim 20, wherein the calculated value, Z-value of the film of the liner bag is in a range between 3,000 and 6,000 $mil^3$ psi/100 percent extension.

33. The freezer bag according to claim 20, wherein the enclosed air space between the liner bag and the support bag is vented to atmosphere outside the support bag.

34. The freezer bag according to claim 20, wherein the enclosed air space between the liner bag and the support bag is essentially unvented.

35. The freezer bag according to claim 20, wherein the enclosed air space between the liner bag and the support bag is vented to the interior of the liner bag.

36. The freezer bag according to claim 35, further comprising a hygroscopic material selected from hydroxypropyl methylcellulose and polyvinyl alcohol disposed within the enclosed air space between the liner bag and the support bag.

37. The freezer bag according to claim 20, further comprising an intermediate layer, located between the liner bag and the support bag, precipitating the liner bag to be conformable to the outside geometry of food within the liner bag while the food is being frozen.

* * * * *